US005879747A

United States Patent [19]

Murakami et al.

[11] Patent Number: 5,879,747

[45] Date of Patent: Mar. 9, 1999

[54] COMPOSITE MATERIAL AND PROCESS OF PRODUCING SAME

[75] Inventors: Youichi Murakami, Aichi; Yoshitaka Natsume, Kariya; Yoshio Satou, Aichi; Yoshio Miyata, Ichinomiya, all of Japan

[73] Assignee: Nippondenso Co., Ltd., Aichi-Pref, Japan

[21] Appl. No.: 755,149

[22] Filed: Nov. 22, 1996

Related U.S. Application Data

[63] Continuation of Ser. No. 538,225, Oct. 3, 1995, abandoned, and a continuation of Ser. No. 115,095, Sep. 2, 1993, abandoned.

[30] Foreign Application Priority Data

| | | | |
|---|---|---|---|
| Oct. 20, 1992 | [JP] | Japan | 4-307636 |
| Mar. 1, 1993 | [JP] | Japan | 5-040233 |
| Jun. 4, 1993 | [JP] | Japan | 5-134887 |
| Jun. 23, 1993 | [JP] | Japan | 5-152071 |

[51] Int. Cl.[6] ..... H01B 1/02; H01B 1/04

[52] U.S. Cl. ..... 427/384; 75/956; 252/503; 411/2; 411/11; 427/180; 427/372.2; 427/421; 427/427; 428/308.4; 428/539.5; 428/545

[58] Field of Search ..... 75/956; 252/503; 411/2, 11; 428/545, 308.4, 539.5; 427/180, 372.2, 384, 421, 427

[56] References Cited

U.S. PATENT DOCUMENTS

| | | | |
|---|---|---|---|
| 3,078,552 | 2/1963 | Grandey | 419/2 |
| 3,705,450 | 12/1972 | Morisaki | 29/182.3 |
| 3,839,080 | 10/1974 | Jarema et al. | 428/312.2 |
| 3,883,314 | 5/1975 | Schnyder et al. | 29/182.5 |
| 4,208,472 | 6/1980 | Cho et al. | 428/550 |
| 4,338,360 | 7/1982 | Cavanagh | 427/247 |
| 4,655,944 | 4/1987 | Mori | 252/12.2 |
| 4,716,766 | 1/1988 | Baureis | 73/827 |
| 5,217,814 | 6/1993 | Kawakami et al. | 428/545 |

FOREIGN PATENT DOCUMENTS

| | | |
|---|---|---|
| 5327419 | 8/1978 | Japan . |
| 56-24778 | 3/1981 | Japan . |
| 59-103022 | 6/1984 | Japan . |

*Primary Examiner*—Paul Lieberman
*Assistant Examiner*—Gregory R. Delcotto
*Attorney, Agent, or Firm*—Pillsbury Madison & Sutro LLP

[57] ABSTRACT

An electroconductive composite material composed of a three-dimensional continuum of a porous metal with the pores filled with graphite and a resin, having a good heat resistance, wear resistance, strength and thermal conductivity, having a light weight, and particularly useful as electric armature brushes and other electric sliding elements.

A process of producing the composite material comprises the steps of: filling pores of a three-dimensional continuum of a porous metal with a pasty mixture composed of graphite, a binder, and a solvent; treating the continuum for volatilization of the solvent; and then, forming and heating the continuum.

4 Claims, 20 Drawing Sheets

COMPOSITE MATERIAL AND PROCESS OF PRODUCING SAME

This is a continuation of application Ser. No. 08/538,225, filed on Oct. 3, 1995, abandoned upon the filing hereof; and a continuation of application Ser. No. 08/115,095, filed on Sep. 2, 1993, abandoned.

BACKGROUND OF THE INVENTION

1. Field of the Invention

The present invention relates to a composite material for sliding parts such as pulleys, retainers, sliding parts housings and friction members, and for sliding parts of electric armatures, such as commutator brushes.

2. Description of the Related Art

Conventionally, sliding parts such as pulleys, retainers, housings and friction members are made of resin. Resin is lightweight and easy to work, allowing inexpensive manufacture.

Resin, on the other hand, is inferior in heat resistance, wear resistance, strength and heat conductivity. Therefore, sliding parts made of resin have a short lifetime.

To avoid these drawbacks, a resin mixed with a metal powder is used. Metal is superior to resin in heat resistance, wear resistance, strength and heat conductivity. The mixing of a metal powder in a resin is intended to impart these characteristic properties of metal to the mixture.

The mixture, however, is heavy because a great amount of metal powder must be added to a resin to avoid the above drawbacks.

Conventional electric armature brushes are mostly composed of a metal powder (predominantly of Cu) for providing electric conductivity, graphite for lubrication, and a binder. Among these components, the metal powder mostly has an adverse effect on wear resistance, and therefore, is preferably present in as small an amount as possible, though it is necessary to provide good electric conductivity.

The metal is mostly used in the form of a powder (such as electrolytic powders, atomized powders, and flake powders) in order for the metal to disperse well over the mixture. The metal powder, however, is present as discrete particles in the mixture and causes the mixture to be less conductive than expected from the metal amount contained in the mixture, so that an undesirably great amount of metal powder is unavoidably added in the mixture to ensure good conductivity, even though the lifetime (wear resistance) is reduced. Thus, the conventional electric armature brush has a poor resistance to wearing, because of a great amount of metal powder contained therein.

SUMMARY OF THE INVENTION

The object of the present invention is to provide a composite material having a good heat resistance, wear resistance, strength and heat conductivity as well as being lightweight, specifically an electric armature brush having both conductivity and wear resistance, and a process of producing such a composite material.

To achieve the object according to the present invention, there is provided a composite material having electric conductivity and composed of a three-dimensional continuum of a porous metal having pores filled with graphite and a resin.

The three-dimensional continuum of a porous metal may consist of a foamed metal.

According to the present invention, there is also provided a process of producing a composite material, the process comprising the steps of: filling pores of a three-dimensional continuum of a porous metal with a pasty mixture composed of graphite, a binder, and a solvent; treating the continuum for volatilization of the solvent; and then, pressing and heating the continuum.

Vacuum impregnation may be used to conduct the step of filling the pores of the three-dimensional continuum of the porous metal with the pasty mixture.

Typically, the pasty mixture is made fluid by heating and is then filled in the pores of the continuum of the porous metal.

Preferably, the step of filling the pores of the continuum of the porous metal with the pasty mixture is conducted by pressurizing the pasty mixture so as to force it to enter the pores.

Preferably, the continuum of the porous metal is filled with the mixture of graphite and the binder while the continuum is vibrated.

According to the present invention, there is also provided a process of producing a composite material, the step comprising the steps of:

adding a solvent to a mixture composed of graphite and a binder to form a pasty mixture; and spraying the pasty mixture to a three-dimensional continuum of a porous metal, filling pores of the continuum of the porous metal, and then subjecting the continuum for volatilization of nonessential solvent.

Preferably, the solvent is added to the graphite and the binder in an amount of 50 to 65 wt. % of the total weight to form the pasty mixture.

Preferably, the pasty mixture is heated and then sprayed onto the continuum of the porous metal.

Also preferably, the graphite is globular or granular.

According to the present invention, there is also provided a process of producing a composite material, the process comprising spraying a mixture composed of graphite and a binder onto a three-dimensional continuum of a porous metal so as to fill pores of the continuum of the porous metal with the mixture.

According to the present invention, there is also provided a process of producing a sliding element, the process comprising the steps of: adding a solvent to a treated powder composed of graphite and a binder in an amount of 50 to 65 wt. % of the total weight to form a pasty mixture; spraying the pasty mixture onto a foamed metal so as to fill pores of the foamed metal with the pasty mixture; and then treating the foamed metal for volatilization of nonessential solvent.

According to the present invention, there is also provided a process of producing a sliding element, the process comprising the steps of: adding a solvent to a treated powder composed of graphite and a binder to form a pasty mixture; heating and then spraying the pasty mixture onto a foamed metal so as to fill pores of the foamed metal with the pasty mixture; and then treating the foamed metal for volatilization of nonessential solvent.

According to the present invention, there is also provided a process of producing a sliding element, the process comprising the step of spraying a treated powder composed of graphite and a binder onto a foamed metal so as to fill pores of the foamed metal with the treated powder.

DESCRIPTION OF THE PREFERRED EMBODIMENTS

EXAMPLE 1

An embodiment of the present invention will be described below with reference to the attached drawings.

Figure 1:
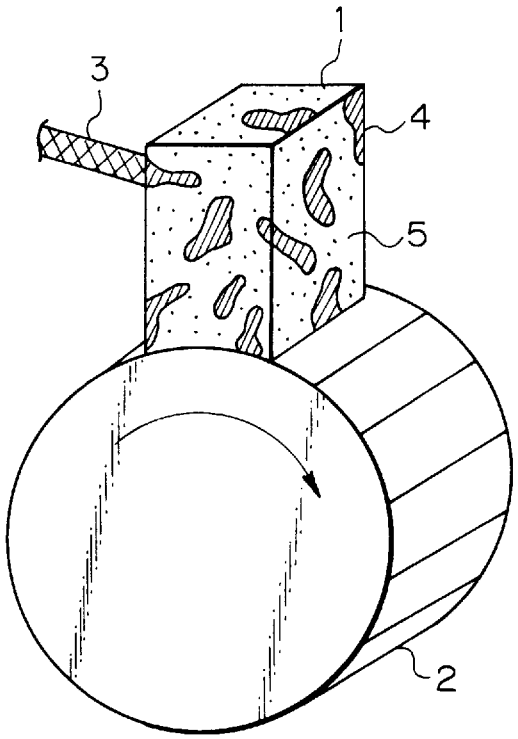
FIG. 1 shows an electric armature brush of an example according to the present invention, in a perspective view.

FIG. 1 shows an armature brush 1 according to the present invention when mounted on an electric motor. The armature brush 1 is cubic in shape and is pressed against a commutator 2 by a spring (not-shown). As the commutator 2 rotates, the armature brush 1 slides on the commutator 2 so as to retain the electrical connection between a lead 3 and the commutator 2.

The armature brush 1 was produced by filling a graphite 5 in pores of an electroconductive porous metal 4. In this example, the porous metal 4 is a nickel article commercially available as "Celmet" produced by Sumitomo Denko Limited.

The brush 1 has the composition recited in Table 1.

TABLE 1

| | Inventive Brush | Comparative Brush |
|---|---|---|
| Metal content | Ni 22 wt % | Cu 34 wt % |
| Carbon content | balance | balance |

Figure 2:
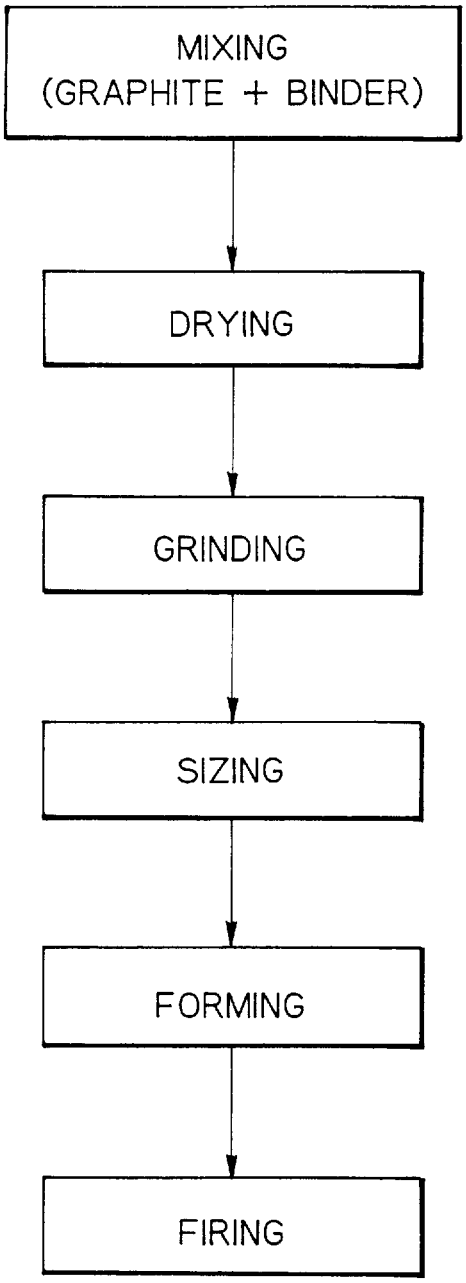
FIG. 2 is a flowchart showing process steps for producing an electric armature brush.
Figure 3A:
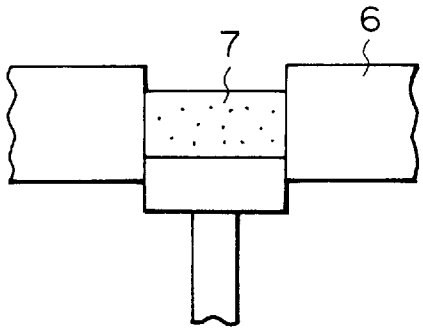
FIGS. 3(*a*) to 3(*d*) shows process steps for producing an electric armature brush.
Figure 3B:
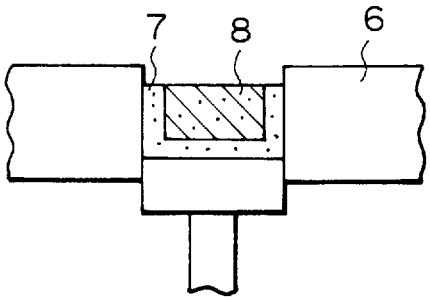
Figure 3C:
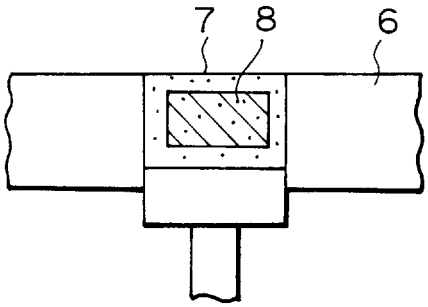
Figure 3D:
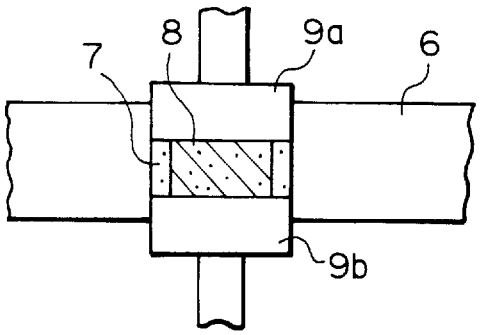

Referring to FIG. 2, the process of producing the armature brush 1 will be described below.

Graphite and a binder (phenol, etc.) are first mixed with alcohol. The alcohol is then volatilized to dry the mixture. Thereafter, the graphite is subjected to grain size adjustment by grinding and sizing to prepare a treated graphite.

Next, a forming step is carried out. This step will be described by referring to FIGS. 3(*a*) to 3(*d*). The treated graphite 7 is filled in a die 6 (FIG. 3(*a*)) and a Ni porous metal 8 (product of Sumitomo Denko Limited, trade name "Celmet") is placed in the filled graphite 7 (FIG. 3(*b*)). The Ni porous metal 8 has substantially the same dimension and size as those of the armature brush 1. An additional amount of the treated graphite 7 is then placed on the Ni porous metal 8 to fill voids (pores) therewith (FIG. 3(*c*)).

To facilitate filling the treated carbon 7 in the voids of the Ni porous metal 8, the die 6 is vibrated so that the treated carbon 7 completely fills the voids and a uniform microstructure is obtained.

Then, a selected pressure is applied by upper and lower punches 9*a* and 9*b* to the treated carbon 7 and the Ni porous metal 8 filled therewith in the die 6 to effect a forming step (FIG. 3(*d*)).

Referring to FIG. 2 again, a baking step is finally carried out to provide a final product.

The above-described process produces an electric armature brush 1 containing 22 wt. % Ni as shown in FIG. 1.

Because the treated carbon is filled in the voids of the Ni porous metal, the filled amount of the treated carbon is small when the proportion of the void is small.

When the Ni porous metal has a small proportion of the voids to be filled with the treated carbon, the filled amount of the treated carbon is then small and the wear or abrasion resistance is reduced. On the other hand, when the proportion of the voids is too large, the porous metal has a low strength and is broken during the pressing step, and also, the performance of the final product is also reduced. From this point of view, the porous metal preferably has a porosity of from 88 to 98% (in terms of $\{1-M/(V\cdot\rho)\}\times100$, where M, V and ρ are the weight, the apparent volume and the true specific gravity of the porous metal).

Figure 4:
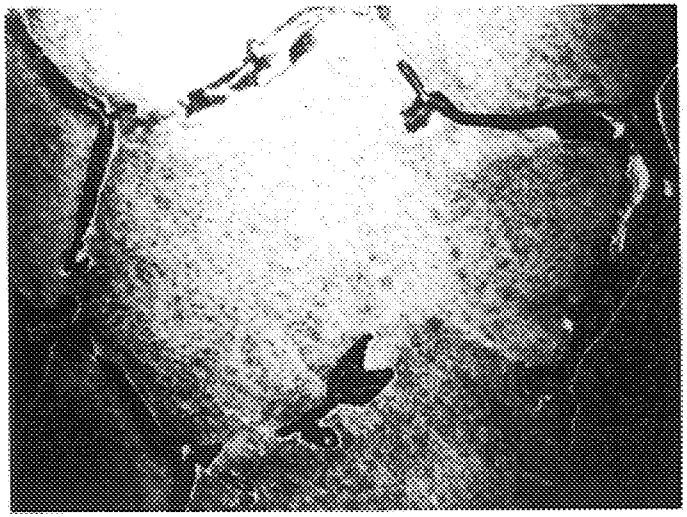
FIG. 4 is a photomicrograph showing a microstructure of an electric armature brush.

FIG. 4 is a photomicrograph showing the electric armature brush 1 at a magnification of 30. It can be seen from this photograph (see also FIG. 5) that the graphite is filled in pores 4*a* of the Ni porous metal 4.

The property of this armature brush 1 was estimated in the following manner. For comparison, estimation was also effected for a conventional metal-graphite brush (containing 34 wt. % Cu powder) as recited in Table 1.

Figure 6:
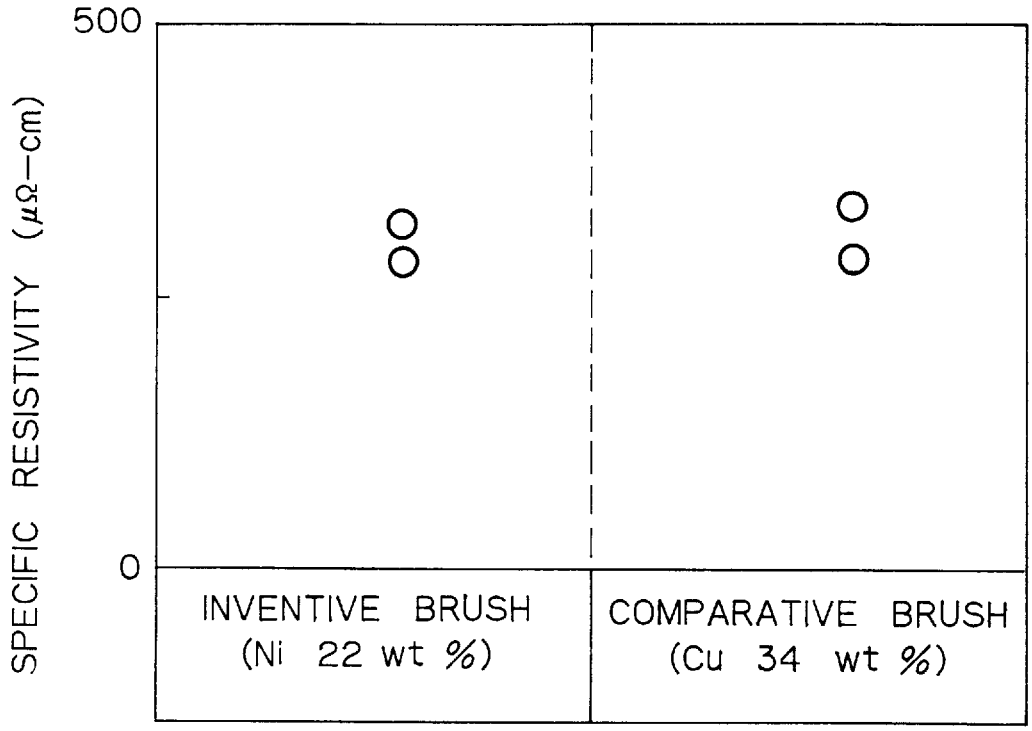
FIG. 6 is a graph showing specific resistivities of electric armature brushes.
Figure 7:
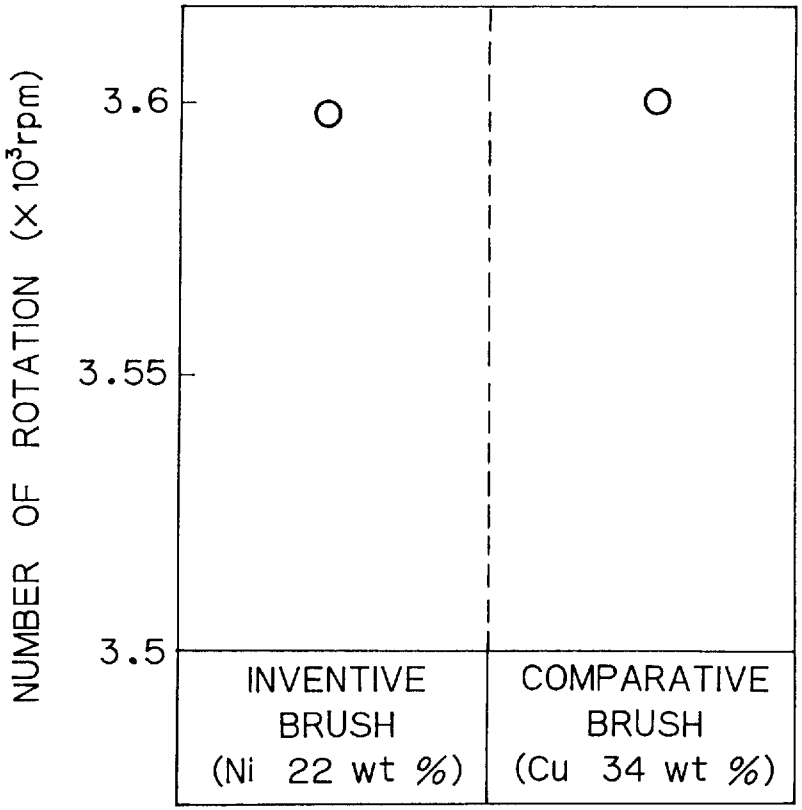
FIG. 7 is a graph showing an estimate of the brush performance (rotation number)
Figure 8:
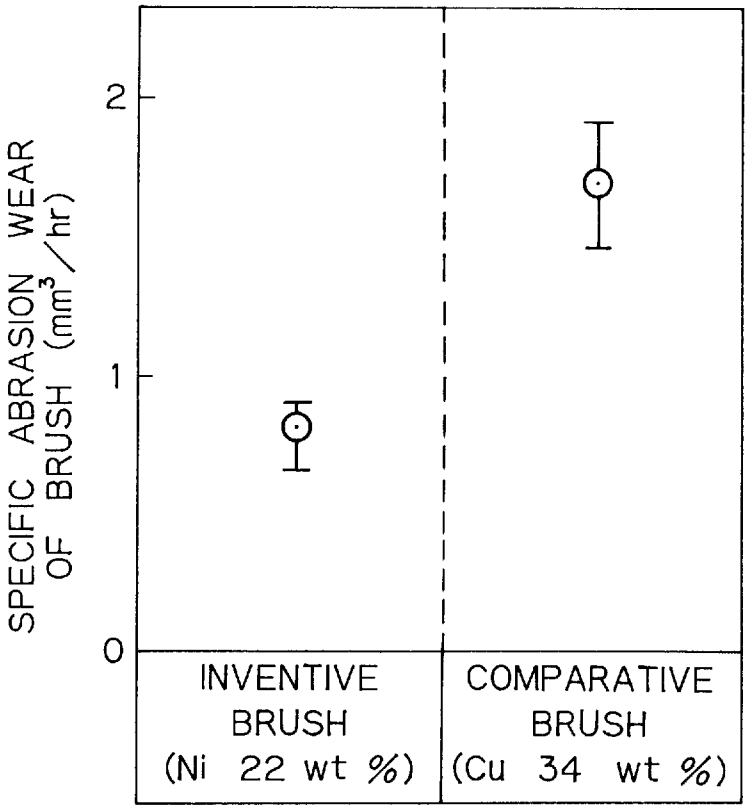
FIG. 8 is a graph showing an estimate of the brush lifetime (abrasion loss)

FIG. 6 shows the observed results of the specific resistivity of the present inventive armature brush 1 and the comparative metal-graphite brush. FIG. 7 also shows the estimated results of the performance (rotation number) of the present inventive brush and the comparative metal-graphite brush when used in a blower motor. FIG. 8 further shows the estimated results of the lifetime (abrasion loss) of the present inventive brush and the comparative metal-graphite brush when used in a blower motor.

It can be seen from these results that the present inventive brush 1 exhibits substantially the same specific resistivity as that of the conventional metal-graphite brush and also exhibits substantially the same performance determined by this resistivity (rotation number) as that of the latter, in spite of the fact that the present inventive brush 1 contains a metal having a greater specific resistivity (Cu: 1.67 μΩcm, Ni: 6.84 μ Ω cm) in a smaller amount than the comparative metal-graphite brush. At the same time, regarding the lifetime, the present inventive brush exhibits an abrasion loss about one half that of the comparative metal-graphite brush.

Thus, in this example, the armature brush 1 is formed of the Ni porous metal 4 having pores 4*a* filled with the graphite 5. The Ni porous metal 4 provides a continuous electric current path. It is possible to increase the content of the graphite 5, which facilitates lubrication, by decreasing the content of the Ni porous metal 4, which facilitates electric conduction. This can reconcile the electric conductivity and the wear resistance.

The conventional way to improve the electric conductivity of a brush is to use an additive component (such as a powder of Cu or other metal) having a smaller specific resistance than that of the matrix graphite (including a binder), so that the improvement of the electric conductivity significantly relies upon the continuity of the component metal other than the specific resistivity of the metal (i.e., the greater the continuity, the greater the improvement in the electric conductivity). The additive metal is mostly used in a powder form to provide good dispersion during a mixing procedure, but a powder has too poor a continuity to provide a decrease in the specific resistivity to an extent proportional to the additive amount. On the other hand, the brush abrasion wear increases with the increase in the amount of the additive metal. Therefore, from the view point of abrasion wear, it is desired to provide an improved electric conductivity at an as small as possible amount of the additive metal. The brush disclosed in this example is composed by using a porous metal continuum, so that the electric conductivity can be improved by a small amount of the additive to reduce the abrasion wear.

EXAMPLE 2

Regarding Example 2, only the difference from Example 1 will be described.

In Example 1, an armature brush using a porous metal was produced by filling a treated graphite in the pores of the porous metal placed in a die, feeding an additional amount of the graphite on the thus-filled porous metal, and then pressing the content of the die by upper and lower punches. This method, however, has a problem in that, when the porous metal has a small mesh (size of the pores), the graphite is not completely filled in the pores to cause collapse to occur during the pressing operation (see FIG. 9), leaving graphite-lacking pores having an adverse effect on the lifetime.

Figure 9:
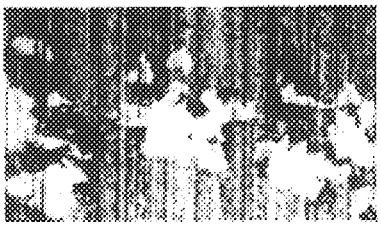
FIG. 9 is a photomicrograph showing a microstructure of an electric armature brush.

In FIG. 9, the white portions are occupied by the porous metal, as also exhibited in FIGS. 13, 15 and 17 referred to later herein.

This example states a process of producing a brush in which a treated graphite can be completely filled in minute pores of a porous metal.

Figure 10:
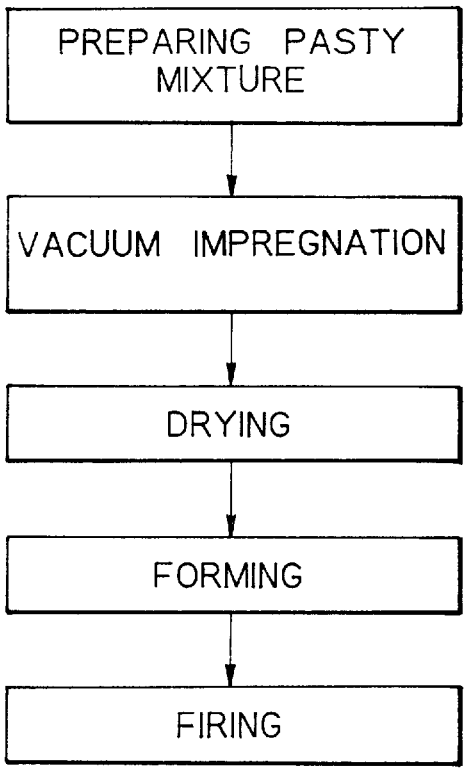
FIG. 10 is a flowchart showing the process steps for producing an electric armature brush in Example 2 according to the present invention.

FIG. 10 shows this process sequence to produce a brush.

30% graphite, 30% phenol and 40% ethanol were first mixed to form a pasty mixture, in which a Ni porous metal (product of Sumitomo Denko Limited, trade name "Celmet") was then placed. The Ni porous metal had a small mesh (size of pores).

The pasty mixture including the Ni porous metal was placed in a vacuum dryer and heated there at about 80° C. in vacuum. This extracted the air from minute pores of the porous metal and the pasty treated graphite (phenol+graphite+alcohol) was impregnated in the air-extracted pores instead. The alcohol contained in the treated graphite was volatilized because of being heated. Thus, the minute pores of the porous metal were filled with the graphite and the phenol.

Thereafter, pressing and baking steps were carried out.

Figure 11:
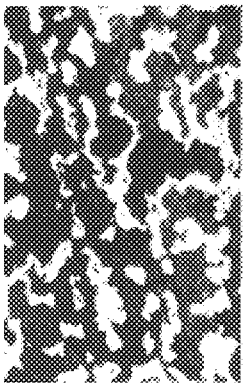
FIG. 11 is a photomicrograph showing a microstructure of an electric armature brush.

FIG. 11 shows a photomicrograph of the thus-produced armature brush. It can be seen from this photograph that a good microstructure was obtained, in which the graphite and the phenol completely fill the pores of the Ni porous metal without collapse.

The commercially available form of the porous metal having small pores includes a thin plate, which may be used to produce an armature brush by being laminated and then pressed in the pressing step. This also applies in the following Examples 3 to 5.

This example thus produces an armature brush using a porous metal having small pores, by filling a pasty mixture of graphite, a binder (phenol), and a solvent (alcohol) in the pores of the porous metal by vacuum impregnation, volatilizing the solvent (alcohol) at an elevated temperature, and conducting forming and firing steps.

EXAMPLE 3

Regarding Example 3, only the difference from Example 1 will be described.

This example also states a process of producing a brush in which a treated graphite can be completely filled in minute pores of a porous metal.

Figure 12:
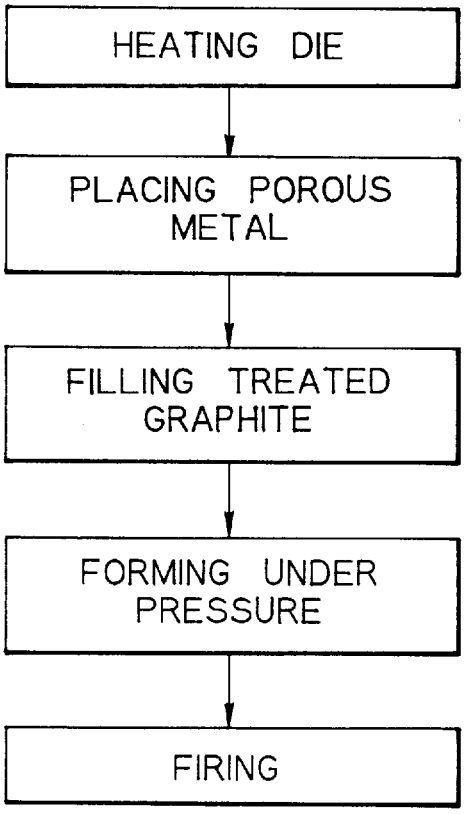
FIG. 12 is a flowchart showing the process steps for producing an electric armature brush in Example 3 according to the present invention.

FIG. 12 shows this process sequence to produce a brush.

A Ni porous metal (product of Sumitomo Denko Limited, trade name "Celmet") was placed in a die heated at about 150° C. This Ni porous metal had a small mesh (size of pores).

A powder mixture of 50% graphite and 50% phenol was filled in the die and pressed by upper and lower punches with the die maintained heated at about 150° C. During the pressing procedure, the phenol was in the molten state because of being heated, so that the pressing by the upper and lower punches caused the phenol and the graphite to be filled in the small pores of the porous metal. Thereafter, a firing step was carried out.

Figure 13:
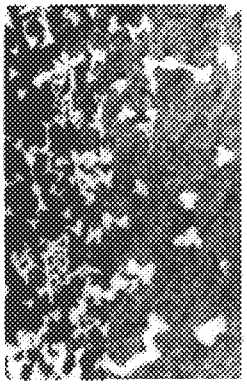
FIG. 13 is a photomicrograph showing a microstructure of an electric armature brush.

FIG. 13 is a photomicrograph showing the microstructure of the thus-produced armature brush. It can be seen from this photograph that a good microstructure was obtained, in which the graphite and the phenol completely fill the pores of the Ni porous metal without collapse.

This example thus produces an armature brush using a porous metal having small pores, by filling a mixture of graphite and a binder (phenol) in the pores of the porous metal by forming under pressure with the mixture made fluid by heating at 150° C. and then firing.

EXAMPLE 4

Regarding Example 4, only the difference from Example 1 will be described.

This example also states a process of producing a brush in which a treated graphite can be completely filled in minute pores of a porous metal.

Figure 14:
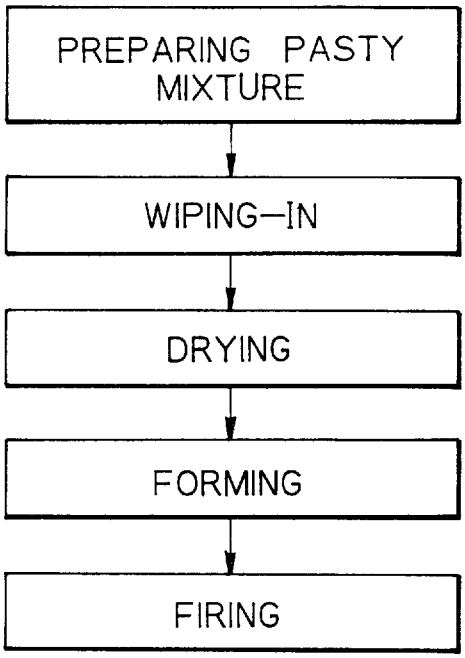
FIG. 14 is a flowchart showing the process steps for producing an electric armature brush in Example 4 according to the present invention.

FIG. 14 shows this process sequence to produce a brush.

30% graphite, 30% phenol and 40% ethanol were mixed to form a pasty mixture, which was then wiped into a Ni porous metal (product of Sumitomo Denko Limited, trade name "Celmet") by means of a roller or the like. Specifically, a pasty treated graphite was applied on the Ni porous metal and a rotating roller was pressed onto the applied pasty treated graphite.

Then, the alcohol was volatilized at an elevated temperature in a vacuum in a vacuum dryer and a forming step was carried out by upper and lower punches in a die. Thereafter, a firing step was carried out.

Figure 15:
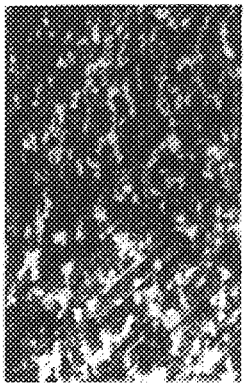
FIG. 15 is a photomicrograph showing a microstructure of an electric armature brush.

FIG. 15 is a photomicrograph showing the microstructure of the thus-produced armature brush. It can be seen from this photograph that a good microstructure was obtained, in which the graphite and the phenol completely fill the pores of the Ni porous metal without collapse.

This example thus produces an armature brush using a porous metal having small pores, by pressing a pasty mixture of graphite, a binder (phenol), and a solvent (alcohol) into the pores of the porous metal, volatilizing the solvent (alcohol) at an elevated temperature in vacuum, and conducting forming and firing steps.

EXAMPLE 5

Regarding Example 5, only the difference from Example 1 will be described.

This example also states a process of producing a brush in which a treated graphite can be completely filled in minute pores of a porous metal.

Figure 16:
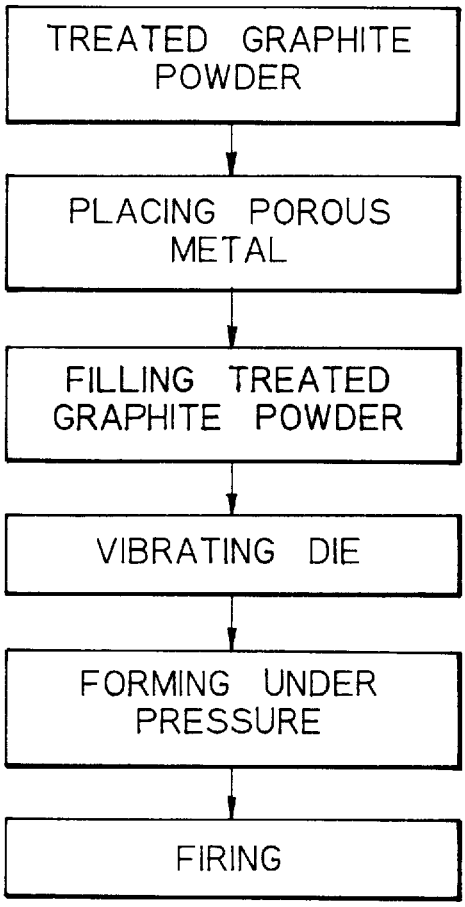
FIG. 16 is a flowchart showing the process steps for producing an electric armature brush in Example 5 according to the present invention.

FIG. 16 shows this process sequence to produce a brush.

63% graphite, 10% phenol and 27% ethanol were mixed, dried and ground to form a treated graphite, which was then fed onto a Ni porous metal (product of Sumitomo Denko Limited, trade name "Celmet") placed in a die. The die was then vibrated to fill the treated graphite in minute pores of the porous metal and then pressed by upper and lower punches to provide a selected form. Thereafter, a baking step was performed.

Figure 17:
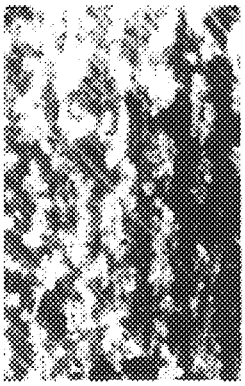
FIG. 17 is a photomicrograph showing a microstructure of an electric armature brush.

FIG. 17 is a photomicrograph showing the microstructure of the thus-produced armature brush. It can be seen from this photograph that a good microstructure was obtained, in which the graphite and the phenol completely fill the pores of the Ni porous metal without collapse.

This example thus produces an armature brush using a porous metal having small pores, by filling a mixture of graphite and a binder (phenol) in the pores of the electroconductive porous metal under vibration and conducting forming and firing steps.

The present invention is not limited to the above-described examples and the present inventive brush may be applied in generators and the like, other than electric motors.

As hereinabove described, the present invention has an advantage that the electric conductivity and the abrasion resistance can be reconciled.

EXAMPLE 6

Referring to FIGS. 18 to 21, Example 6 will be described.

Figure 18:
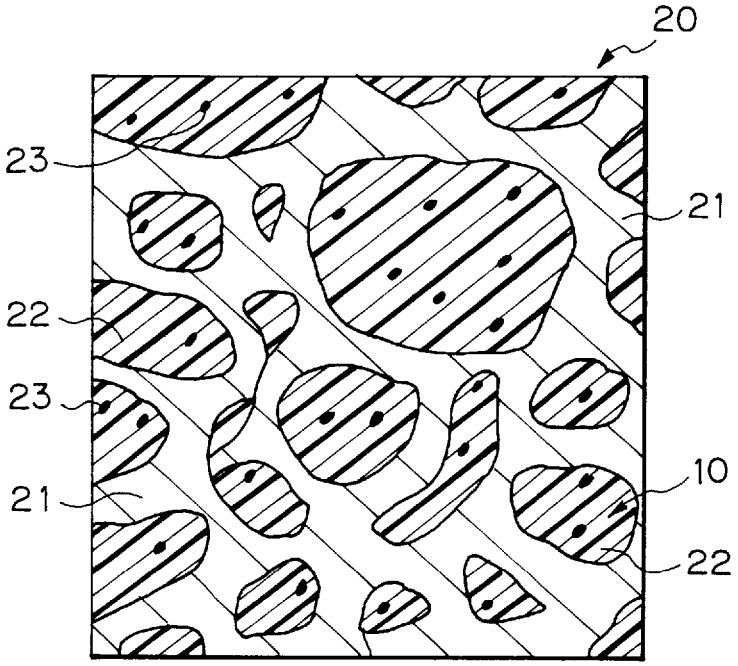
FIG. 18 is an enlarged sectional view of a composite material of Example 6 according to the present invention.
Figure 20:
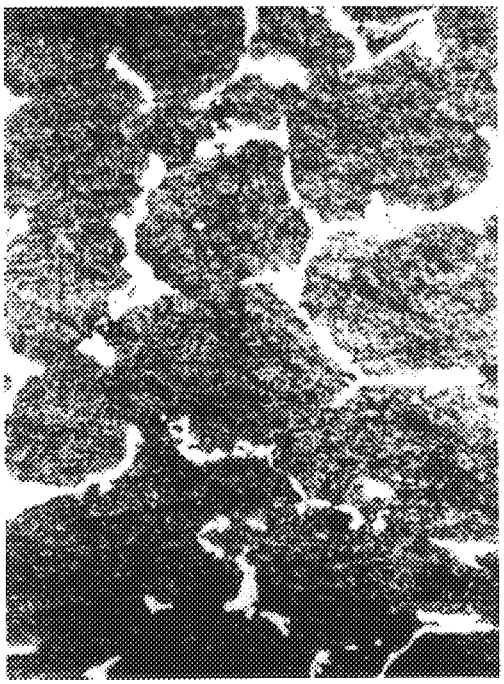
FIG. 20 is a photomicrograph (magnification of 50) showing a microstructure of a composite material of Example 6 according to the present invention.

As shown in FIGS. 18 and 20, a composite material 20 of this example is composed of a porous metal 21 having a three-dimensional network skeleton structure and a resin 2 filled in pores 25 of the porous metal 21.

The composite material 20 consists of 32 wt. % of the porous metal 21 and 68 wt. % of the resin 22 as summarized in Table 2.

Figure 19:
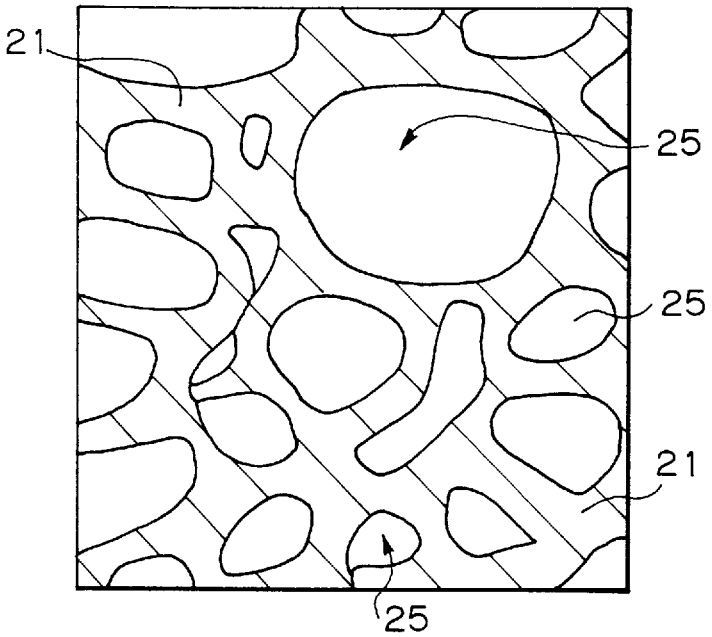
FIG. 19 is an enlarged sectional view of a porous metal of Example 6 according to the present invention.
Figure 21:
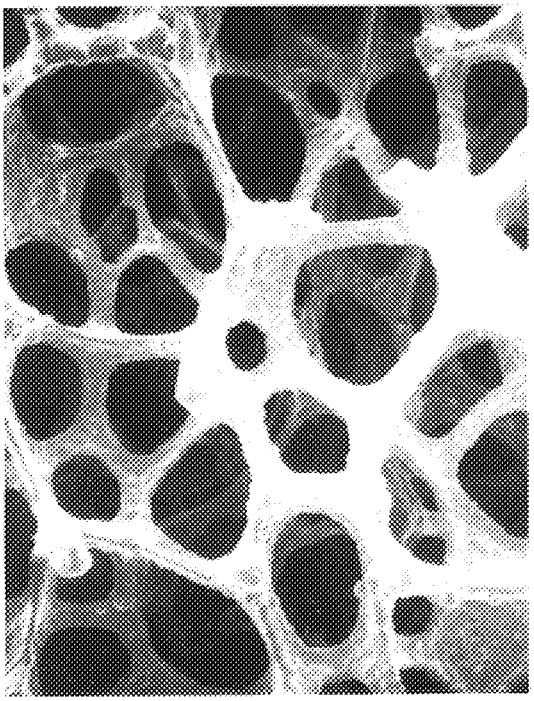
FIG. 21 is a photomicrograph showing a microstructure of a porous metal of Example 6 according to the present invention.

The porous metal 21 is a porous copper (product of Sumitomo Denko Limited, trade name "Celmet"). The porous metal 21 has a three-dimensional network structure including numerous pores 25 as shown in FIGS. 19 and 21.

The resin 22 is phenol in which natural graphite 23 is added to improve the electric conductivity.

The composite material 20 is produced by utilizing charge of a pasty resin.

Namely, the porous metal is first prepared.

Separately, equal amounts of phenol, natural graphite and a solvent are mixed together. The solvent is alcohol. This procedure produces a pasty resin.

Next, the pasty resin is charged in the pores 25 of the porous metal 21 by wiping with a spatula and the solvent is then volatilized at an elevated temperature of 80° C. A pressing procedure is performed under a pressure of 3.5 ton/$m^2$ to provide a selected form. Thereafter, a baking step is carried out at about 250° C. to produce the composite material of this example.

This composite material has the following advantages.

The porous metal 21 of this example is a three-dimensional continuum having a three-dimensional network skeleton structure as shown in FIGS. 19 and 21. This better ensures a heat path than the conventional composite material in which a metal powder is used. This provides a better heat radiation and resistance to heat.

By virtue of the three-dimensional network structure of the porous metal, the composite material 20 has an improved strength and abrasion resistance by using a smaller amount of the porous metal 21 than the metal amount used in the conventional composite material. This also enables the composite material 20 to be lighter in weight than the conventional composite material.

EXAMPLE 7

Photomicrographs were taken of the microstructures of the composite material and porous metal of Example 6, as shown in FIGS. 20 and 21.

FIG. 20 shows the composite material, in which the light images correspond to the portions of the porous metal and the dark images correspond to the portions of the resin filled in the porous metal.

FIG. 21 shows the porous metal, in which the dark images correspond to the skeleton structure of the porous metal. It can be seen that the skeleton structure has a three-dimensional network form.

These photographs prove that the porous metal has a three-dimensional network structure with the pores solid with a charge of the resin.

EXAMPLE 8

Measurement was performed of the density (g/cm$^3$), electric conductivity (1/$\mu\Omega$–cm), and specific abrasion wear (mm$^3$/hr) of the composite material of Example 6 (sample 1).

For comparison, another composite material (sample 2) was prepared by mixing a porous metal and a resin at proportions of 72 wt. % and 28 wt. %, respectively, which was then subjected to measurement of the same items. The results obtained are summarized in Table 3.

In Table 3, the specific abrasion wear was measured by using a Cu reference material under the conditions of a bearing pressure of 0.52 kg/cm$^2$, a sliding speed of 4.5 m/sec, and a sliding duration time of 100 hours.

It can be seen from Table 3 that the composite material of Example 6 was lighter in weight or had a density as small as half that of the comparative sample.

There was no difference in the electric conductivity between Samples 1 and 2.

It should be noted that, according to Wiedemann-Franz's law, the thermal conductivity, K, and the electric conductivity, $\sigma$, can be related by the formula $K=LT\sigma$ (L: Lorentz number, T: temperature). According to this formula, the thermal conductivity is proportional to the electric conductivity.

Therefore, it can be seen that the same good results as exhibited by Sample 2 were obtained both in the electric and thermal conductivities.

The composite material of Example 6 exhibited a specific abrasion wear as small as about one third that of Sample 2.

The above-recited results show that the composite material of the present invention has good heat resistance, wear resistance, strength and thermal conductivity and has a light weight.

TABLE 2

Mixed Compositions of Composite Materials

| | Sample 1 | Sample 2 |
|---|---|---|
| Metal amount | 32% | 72% |
| Resin | 68% | 28% |

TABLE 3

Measured Data of Composite Materials

| | Example 1 | Comparative sample |
|---|---|---|
| Density (g/cm$^3$) | 2.4 | 4.5 |
| Electric conductivity (1/$\mu\Omega$-cm) | 0.072 | 0.083 |

TABLE 3-continued

Measured Data of Composite Materials

| | Example 1 | Comparative sample |
|---|---|---|
| Specific wear (mm$^3$/hr) | 0.15 | 0.42 |

The present invention provides a composite material characterized by being composed of a porous metal having a three-dimensional network skeleton structure and a resin filled in pores of the porous metal.

In the present invention, the porous metal is a metal which forms a three-dimensional network structure. The network contains spaces forming pores which are filled with a resin.

The three-dimensional network structure is a three-dimensional structure having continuous metal skeletons crossing each other. An example of such a porous metal is a foamed metal.

A foamed metal is made of, for example, copper (Cu), nickel (ni), lead (Pb), or tin (Sn).

Each of the pores preferably has a size of 10 to 500 $\mu$m in diameter. Pores having a size of smaller than 10 $\mu$m are difficult to be fill with a resin. On the other hand, when the pores have a size of greater than 500 $\mu$m, the porous metal may have a poor strength.

The resins include phenol, nylon and other resins. The resins preferably contain an additive of graphite or other components to improve the electric conductivity.

The porous metal preferably has a porosity of 90 to 98% in terms of the percentage of the pore volume relative to the gross volume of the porous metal.

When the porosity is less than 90%, the volume filled with the resin is too small to provide a significant effect of reducing weight. On the other hand, when the porosity is more than 98%, the skeleton of the porous metal is thin so that the composite material has a poor strength, thermal conductivity, wear resistance, and electric conductivity.

The porosity is calculated by the following formula:

Porosity (%)=100− (100×weight of porous metal)/(volume of porous metal×density of porous metal)

A preferred metal content of the composite material is 10 to 50 wt. %. A metal content of less than 10 wt. % may reduce the heat resistance, the wear resistance and the strength. A metal content of more than 50 wt. % may reduce the effect of reducing weight.

To produce the composite material, the resin is filled in the pores of the porous metal by any of methods available for charging a pasty resin, spraying a liquid resin, or pressurizing and melting a resin, etc. These methods are performed in the following ways.

To perform the method of charging a pasty resin, a porous metal is first prepared. A pasty resin is separately prepared by mixing a resin and a solvent. The solvent is alcohol, xylene or other solutions which are easy to volatilize.

The pasty resin is then wiped into pores of the porous metal, and after the solvent is volatilized, the resin-charged porous metal is pressurized to form a composite material with a selected shape according to the present invention.

To perform the method of spraying a liquid resin, a liquid resin is made from the resin and the solvent and the liquid resin is then sprayed onto the porous metal. After the solvent is volatilized, the resin-sprayed porous metal is pressurized to form a composite material with a selected shape according to the present invention.

To perform the method of pressurizing and melting a resin, a porous metal is placed in a pre-heated die, to which a resin is then added, followed by pressurization. In this method, the resin is made molten by the heat and filled in the porous metal by the pressurization.

The porous metal according to the present invention has a network skeleton of a three-dimensional continuum. This better ensures a heat path than the composite material in which a metal powder is used. This provides a better heat radiation and resistance to heat.

By virtue of the three-dimensional network structure of the porous metal, the present inventive composite material has an improved strength and abrasion resistance by containing a smaller amount of metal than that contained in the conventional composite material. This also makes it possible to reduce the weight of a composite material.

Thus, the present invention provides a lightweight composite material having a good heat resistance, abrasion resistance, strength and thermal conductivity.

EXAMPLE 9

Example 9 according to the present invention will be described by referring to FIGS. 22 to 24 and FIG. 5.

Figure 22:
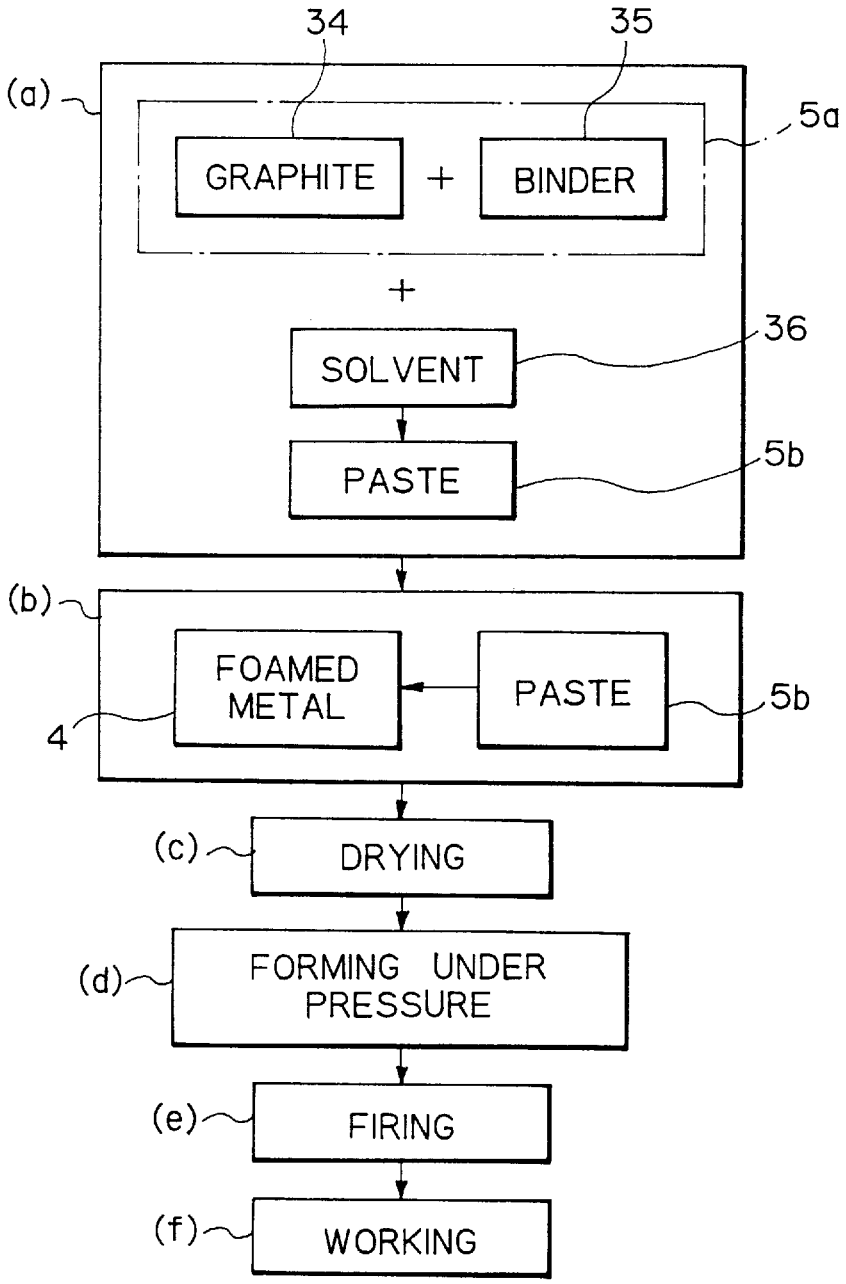
FIG. 22 is a flowchart showing the process steps for producing a sliding element according to the present invention.

FIG. 22 is a flowchart of the process sequence to produce a sliding element.

Figure 5:
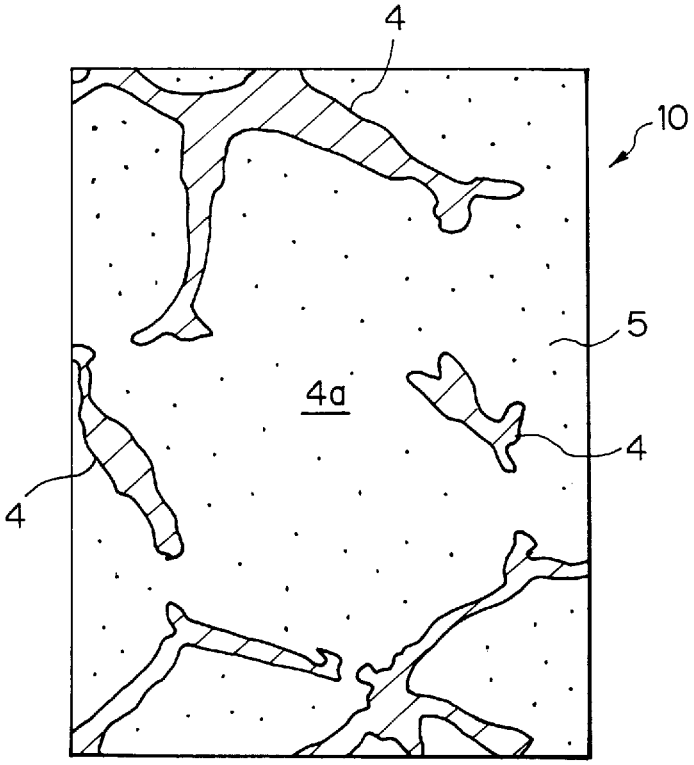
FIG. 5 is a traced drawing of the photograph shown in FIG. 4.

A sliding element 10 of this example has a cross-sectional structure as shown in FIG. 5, is produced by filling a treated graphite 5 in pores 4*a* of a porous metal or foamed metal 4 and is used as an armature brush for electric motors or other rotary electric elements.

A process of producing the sliding element 10 will be described by referring to FIG. 22.

A treated graphite 5*a,* which is composed of graphite 34 and a binder 35, and a solvent 36 are first mixed together to form a pasty treated graphite 5*b* (FIG. 22, (*a*)).

A spray, a pump, etc., are then used to spray the pasty treated graphite 5*b* onto a foamed metal 4, thereby filling the pasty treated graphite 5*b* in pores 4*a* (FIG. 22, (*b*)). In this spraying method, the pasty treated graphite 5*b* is ejected from a nozzle of a spray at so high a speed as to form a mist of fine particles, which are not significantly influenced by the surface tension and easily fill the pores 4*a*.

The nonessential solvent 36 is removed through a drying step (FIG. 22, (*c*)).

The above-described steps produce a foamed metal 4 with the pores 4*a* filled with the treated graphite 5. A plurality of layers of this filled foamed metal 4 are laminated, pressure-formed, baked, and worked to complete the sliding element 1 shown in FIG. 2 (FIG. 22, (*d*)–(*f*)).

Figure 23:
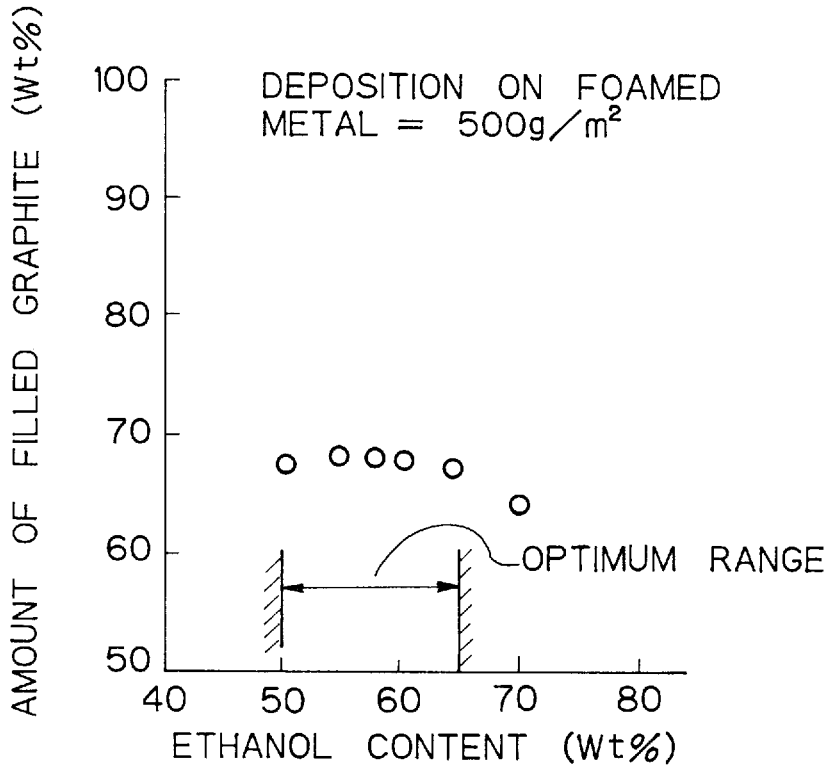
FIG. 23 is a graph showing the relationship between the percentage of solvent mixed and the percentage of filled graphite.

FIG. 23 shows the relationship between the percentage of the solvent 36 mixed with the treated graphite 5*a* and the amount of the treated graphite 5 filled in the pores 4*a* of the foamed metal 4, according to the above-described process.

The foamed metal 4 used was "Celmet" produced by Sumitomo Denko Limited. Ethanol as the solvent 36 was mixed with the treated graphite 5*a* prepared by adding 87 wt. % of graphite 34 (product of Nihon Kokuen, "CPB") to 13 wt. % of phenol (product of Sumitomo Dures).

Under these conditions, the amount of ethanol was varied from 45 to 70 wt. % to form pasty treated graphites 5*b*.

While being agitated, the pasty treated graphites 5*b* were sprayed onto the foamed metal 4 by using an air spray gun (product of Iwata, "Agitator Spray Gun W-88A-13H2g"). The spraying conditions were an air pressure of 2 kg/cm$^2$, a nozzle opening diameter of 1.8 mm, and a distance of 2 cm between the foamed metal 4 and the nozzle.

The foamed metal 4, on which the pasty treated graphite 5*b* had been sprayed, was held at about 80° C. for 3 hours in a vacuum dryer to remove the nonessential alcohol.

The amount of the graphite filled in the pores 4*a* of the foamed metal 4 through the above-described process was determined by the difference between the weight of the foamed metal 4 measured before spraying and the weight of the foamed metal 4 measured after spraying and drying.

In the result (FIG. 23), when the ethanol amount was less than 50 wt. %, the pasty treated graphite 5*b* had too high a viscosity to spray, so that the filled amount of graphite could not be measured.

On the other hand, when the ethanol amount was more than 65 wt. %, the pasty treated graphite 5*b* had a low viscosity such that the sprayed pasty treated graphite 5*b* flowed out of the pores 4*a,* resulting in a reduced amount of the filled graphite.

These results showed that the optimum ethanol amount (solvent amount) to ensure a successful spraying ranges from 50 to 65 wt. %.

EXAMPLE 10

This example provides a comparison between the amount of graphite filled by the spraying method of Example 9 by using an ethanol amount of 56% based on the established optimum range of solvent amount and the amount of graphite filled by the wiping-in method (the most popular method of filling currently used) under the same conditions. The results are summarized in FIG. 24.

Figure 24:
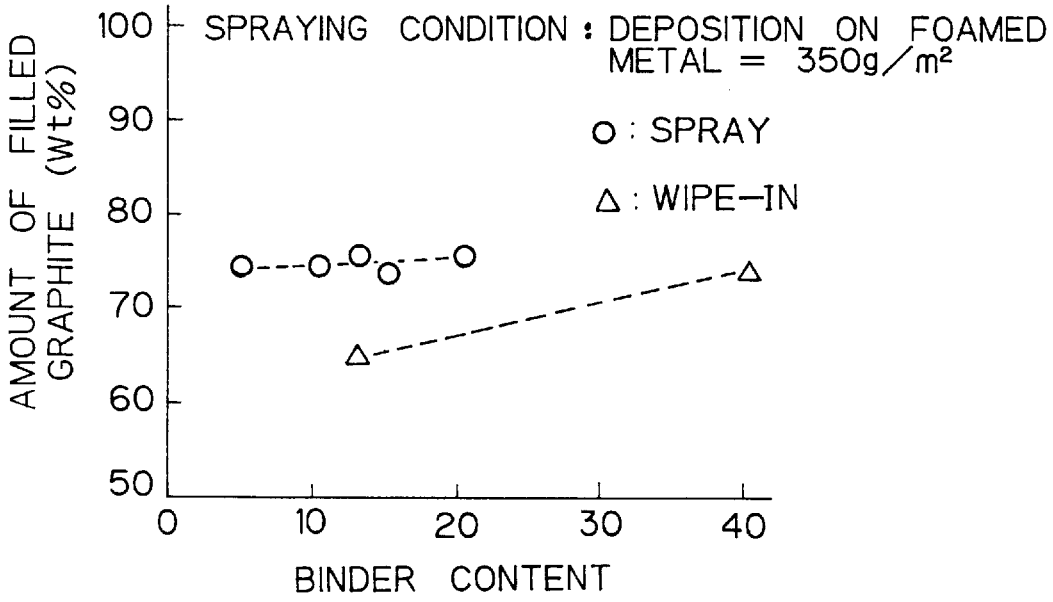
FIG. 24 is a graph showing the relationship between the percentage of binder mixed and the percentage of filled graphite.

The result shown in FIG. 24 shows the relationship between the amount of binder and the amount of filled graphite. To ensure the lubrication of the sliding element 10, the binder amount is preferably limited to a required minimum value. From this point of view, it should be noted that the present inventive method does not cause the amount of filled graphite to be reduced but ensures a higher amount of filled graphite than that obtained by the wiping-in method even when the binder amount is small, whereas the wiping-in method causes the amount of filled graphite to be reduced as the binder amount is reduced.

The time required for filling the treated graphite 5 was compared between the present inventive method and the wiping-in method. The results are summarized in Table 4, from which it can be seen that the present inventive method required only a short time of about one twelfth that required when the wiping-in method was used. This reduction in time can reduce the production cost.

TABLE 4

| | Method | |
|---|---|---|
| | Spraying | Wiping-in |
| Time required to fill treated graphite in 1 cm$^2$ of foamed metal (sec) | 3 | 35 |

EXAMPLE 11

This example provides a comparison between a graphite having a globular or granular shape (hereinafter referred to as "globular graphite") and a conventional graphite having a flaky shape (hereinafter referred to as "flaky graphite")

when sprayed in the process of Example 9 as shown in FIG. 22. The results are summarized in Table 5.

A pasty treated graphite was prepared by adding phenol (Sumitomo Dures PR217K) as a binder either to a globular graphite (product of Nihon Carbon, trade name "Carbon Microbeads PC3020) or to a flaky graphite (product of Nihon Kokuen, CB150) in the same proportion (graphite: 87 wt. %, phenol: 13 wt. %), to which alcohol was added as a solvent. The spraying conditions were the same as those used in Example 9.

Under these conditions, spraying was carried out with the alcohol amount varied. Spraying could not be effected at an alcohol content of less than 50% when the flaky graphite was used, whereas spraying could be effected even at an alcohol content of 28% when the globular graphite was used. Namely, the use of a globular graphite enables the alcohol content required for effecting spraying to be less than that when a flaky graphite is used.

TABLE 5

| Globular graphite used | Flaky graphite used |
|---|---|
| 28% | 50% |

By using the above-determined minimum alcohol content, a pasty treated graphite containing the globular graphite and a pasty treated graphite containing the flaky graphite were sprayed onto a foamed metal under the above-used spraying conditions. The amounts of graphite filled in the pores were compared between these two cases. The results are summarized in Table 6. The amount of filled graphite was determined by the difference between the weight measured before spraying and the weight measured after spraying and drying (drying at 80° C. for 3 hours).

The result showed that the use of the globular graphite provided a amount of filled graphite of 79%, which was 10% greater than the value of 69% obtained by the use of the flaky graphite.

TABLE 6

| Globular graphite used | Flaky graphite used |
|---|---|
| 79% | 69% |

EXAMPLE 12

To examine the lifetime elongation effect by the increased amount of filled graphite obtained by the use of a globular graphite, an abrasion wear test was conducted by mounting an armature brush on a small motor for automobile application and intermittently operating the motor with the cycle of operation for 0.2 sec and a pause for 0.3 sec. The results are summarized in Table 7.

The armature brushes for the test were produced by using a conventional flaky graphite alone and a mixture of 50% of globular graphite (product of Nihon Carbon Limited, trade name "Carbon Micro Beads PC3020"), respectively, according to the process of producing a sliding element described in Example 9 under the same production conditions (as those used in Example 10).

The results showed that the armature brush produced by using the mixture of flaky graphite and globular graphite had a greater amount of filled graphite and an abrasion wear reduced to about one half, in comparison with the armature brush produced by using the flaky graphite alone.

TABLE 7

| | Globular and flaky qraphites used | Flaky qraphite alone used |
|---|---|---|
| Amount of filled graphite (%) | 73 | 69 |
| Specific brush abrasion wear ($mm^3$/hr) | 0.024 | 0.043 |

EXAMPLE 13

To examine the relationship between the grain size of the flaky graphite and the amount of filled graphite, three grades of grain-refined flaky graphites (product of Nihon Kokuen: CSSP, CSP, CPB) were used. The results are summarized in Table 8.

Spraying was conducted under the same conditions as used in Example 10 and the amount of filled graphite was determined by the difference between the weight measured before spraying and the weight measured after spraying and drying (drying at 80° C. for 3 hours).

The results showed that the amount of filled graphite was not improved by grain-refinement of the flaky graphite. This proved that the improvement in the amount of filled graphite is brought about by the globular or granular shape of the graphite, as was shown by the data of Example 10. Namely, the essential feature of the granular graphite is not that it is grain-refined but that it has a globular or granular shape.

TABLE 8

| | Grade of graphite | | | |
|---|---|---|---|---|
| | CP150 | CPB | CSP | CSSP |
| Average grain size (μm) | 40 | 10 | 5 | 1 |
| Amount of filled graphite (%) | 69 | 69 | 67 | 69 |

EXAMPLE 14

When the pasty treated graphite **5*b*** is filled by spraying, the amount of filled graphite can be increased by heating the pasty treated graphite to reduce the viscosity thereof.

The amount of filled graphite can be also increased by spraying only the treated graphite **5*a* composed of graphite 34 and binder 35 onto a foamed metal 4 by means of a powder spray device or the like, not using the nonessential solvent 36** (alcohol).

Other than "Carbon Microbeads PC3020" (trade name) produced by Nihon Carbon Limited that is used in Example 10 and 11, available globular graphites are "PC"-, "ICB"-, "MSB"-, and "MC"-serieses from the same company, "Gurassi P" produced by Owada Carbon Limited, and amorphous graphite.

The process of producing a sliding element according to the present invention specifies the mixing percentage of a solvent (50 to 65 wt. % of the gross weight) to improve the spraying performance of a pasty treated graphite containing graphite having a small specific gravity. A pasty treated graphite may be heated to reduce the viscosity thereof, thereby improving the spraying performance. These both improve the amount of graphite filled in a foamed metal. The amount of filled graphite can be also improved by spraying only the treated graphite composed of graphite and a binder, not using the nonessential solvent.

The amount of filled graphite can be improved by the use of globular or granular shape of graphite.

EXAMPLE 15

A sliding element 10 of this example has a cross-sectional structure as shown in FIG. 5, is produced by filling a treated graphite 5 in pores 4*a* of a porous metal or foamed metal 4 and is used as an armature brush for electric motors or other rotary electric elements.

A process of producing the sliding element 10 will be described by referring to FIG. 22.

A treated graphite 5*a,* which is composed of graphite 34 and a binder 35, and a solvent 36 are first mixed together to form a pasty mixture 5*b* (FIG. 22, (*a*)).

A spray, a pump, etc., are then used to spray the pasty mixture 5*b* onto a foamed metal 4, thereby filling the pasty mixture 5*b* in pores 4*a* (FIG. 22, (*b*)). In this spraying method, the pasty mixture 5*b* is ejected from a nozzle of a spray at so high a speed as to form a mist of fine particles, which are not significantly influenced by the surface tension and easy to fill the pores 4*a.*

The nonessential solvent 36 is removed through a drying step (FIG. 22, (*c*)).

The above-described steps produce a foamed metal 4 with the pores 4*a* filled with the treated graphite 5.

A plurality of layers of the thus-filled foamed metal 4 are laminated, pressure-formed (FIG. 22, (*d*)), fired (FIG. 22, (*e*)), and worked (FIG. 22, (*f*)) to complete the sliding element 10 shown in FIG. 5.

Figure 25:
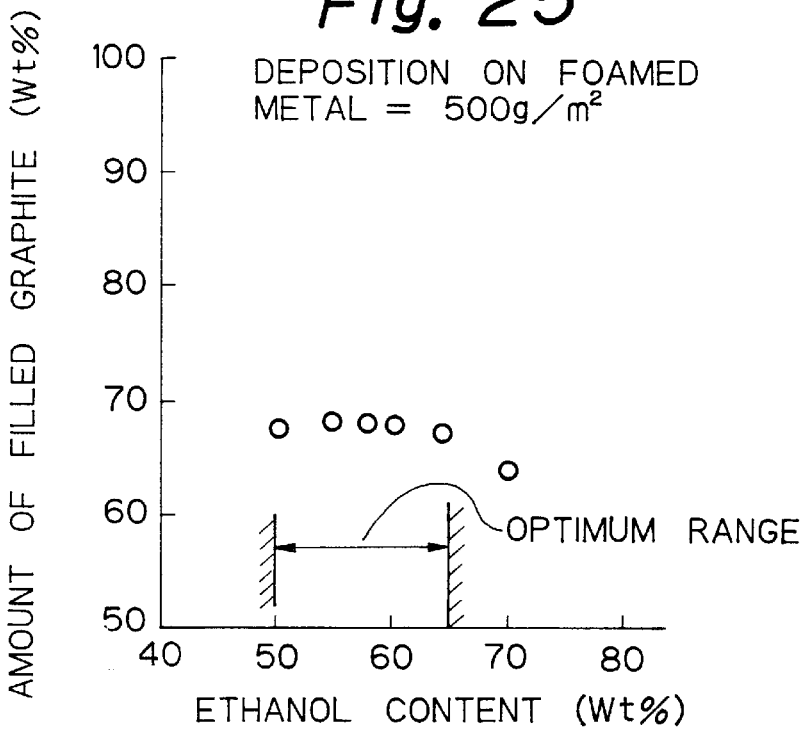
FIG. 25 is a graph showing the relationship between the percentage of solvent mixed and the percentage of filled graphite.

FIG. 25 shows the relationship between the percentage of the solvent 36 mixed with the treated graphite 5*a* and the amount of the treated graphite 5 filled in the pores 4*a* of the foamed metal 4, according to the above-described process.

The foamed metal 4 used was "Celmet" produced by Sumitomo Denko Limited.

The pasty mixture 5*b* was prepared by mixing a treated powder 5*a* composed of 87 wt. % of graphite 34 (product of Nihon Kokuen, "CPB") to 13 wt. % of phenol (binder 35: product of Sumitomo Dures) with ethanol (solvent 36) at different mixing percentages of 45 to 70 wt. %.

Under these conditions, the amount of ethanol was varied from 45 to 70 wt. % to form pasty mixtures 5*b.*

While being agitated, the pasty mixtures 5*b* were sprayed onto the foamed metal 4 by using an air spray gun (product of Iwata, "Agitator Spray Gun W-88A-13H2g"). The spraying conditions were an air pressure of 2 kg/cm$^2$, a nozzle opening diameter of 1.8 mm, and a distance of 2 cm between the foamed metal 4 and the nozzle.

The foamed metal 4, on which the pasty mixture 5*b* has been sprayed, was held at about 80° C. for 3 hours in a vacuum dryer to remove the nonessential alcohol.

The amount of the graphite filled in the pores 4*a* of the foamed metal 4 through the above-described process was determined by the difference between the weight of the foamed metal 4 measured before spraying and the weight of the foamed metal 4 measured after spraying and drying.

In the result (FIG. 25), when the ethanol amount was less than 50 wt. %, the pasty mixture 5*b* had too high a viscosity to spray, so that the filled amount of graphite could not be measured.

On the other hand, when the ethanol amount was more than 65 wt. %, the pasty mixture 5*b* had a low viscosity such that the sprayed pasty mixture 5*b* flowed out of the pores 4*a,* resulting in a reduced amount of the filled graphite.

These results showed that the optimum ethanol amount (solvent amount) to ensure a successful spraying ranges from 50 to 65 wt. %.

A comparison was made between the amount of graphite filled by using an ethanol amount of 56% based on the established optimum range of solvent amount and the amount of graphite filled by the wiping-in method (the most popular method of filling currently used) under the same conditions. The results are summarized in FIG. 26.

Figure 26:
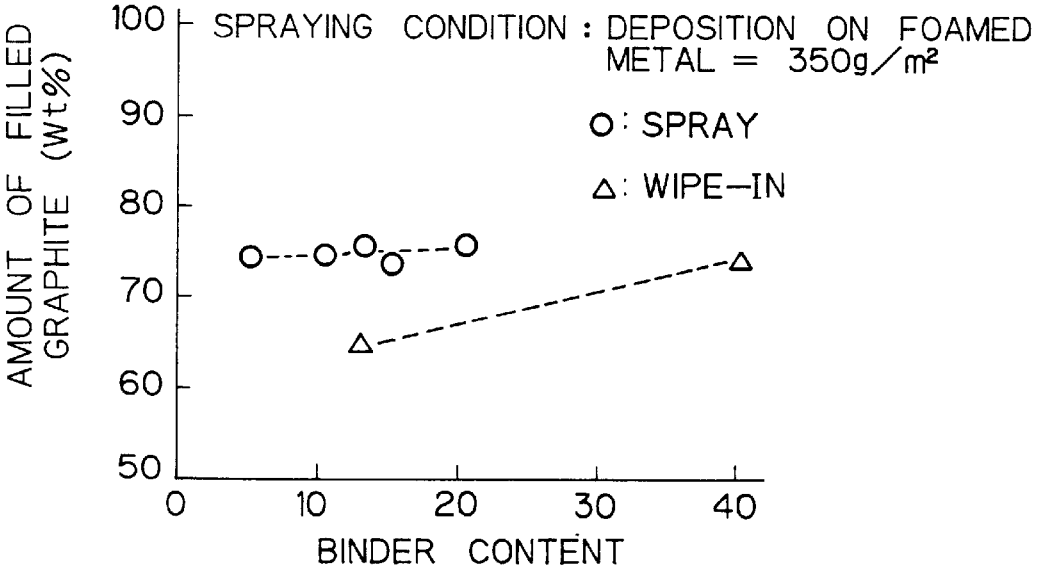
FIG. 26 is a graph showing the relationship between the percentage of binder mixed and the percentage of filled graphite.

The result shown in FIG. 26 shows the relationship between the amount of binder (binding agent 35) and the amount of filled graphite. To ensure the lubrication of the sliding element 10, the binder amount is preferably limited to a required minimum value. From this point of view, it should be noted that the present inventive method does not cause the amount of filled graphite to be reduced but ensures a higher amount of filled graphite than that obtained by the wiping-in method even when the binder amount is small, whereas the wiping-in method causes the amount of filled graphite to be reduced as the binder amount is reduced.

The time required for filling the treated graphite 5 was compared between the present inventive method and the wiping-in method. The results are summarized in Table 4, from which it can be seen that the present inventive method required only a short time of about one twelfth that required when the wiping-in method was used. This reduction in time can reduce the production cost.

TABLE 9

| | Method | |
|---|---|---|
| | Spraying | Wiping-in |
| Time required to fill treated graphite in 1 m$^2$ of foamed metal (sec) | 3 | 35 |

EXAMPLE 16

An armature brush according to the present invention will be described below.

The armature brush 10 has a cross-sectional structure as shown in FIG. 5.

The armature brush 10 of this example was produced by filling a treated graphite 5 in pores 4*a* of a foamed metal 4 which forms a porous body. The production process will be described by referring to FIG. 27.

Figure 27:
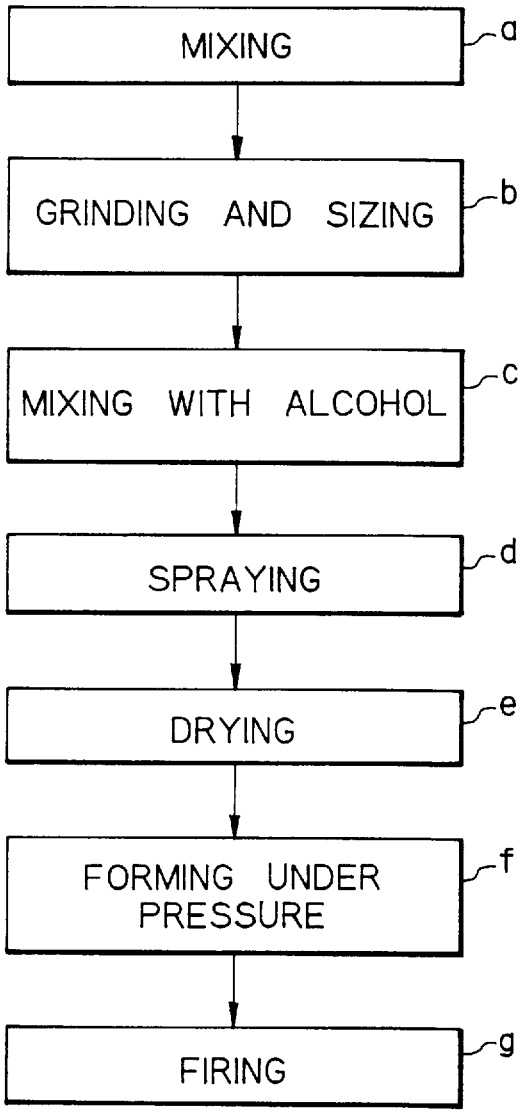
FIG. 27 is a flowchart showing process steps for producing an electric armature brush.

95 wt. % of a natural graphite (Nihon Kokuen PCB) and 5 wt. % of phenol (Sumitomo Dures PR217) as a binder were mixed with 15 wt. % of ethanol (FIG. 27, *a*), and after the nonessential alcohol was volatilized, the mixture was subjected to grinding and sizing procedures to prepare a treated powder (FIG. 27, *b*).

The treated powder was further mixed with 60 wt. % of alcohol to form a pasty treated powder (FIG. 27, *c*), which was then sprayed by an air spray gun onto a foamed metal 4 (product of Sumitomo Denko, trade name "Cu Serumetto") to fill the pasty treated powder in the pores 4*a* of the foamed metal 4 (FIG. 27, *d*).

After drying and volatilizing the nonessential alcohol (FIG. 27, *e*), a plurality of layers of the foamed metal 4 filled with the pasty treated powder are pressure-formed under a forming pressure of 1 ton/cm$^2$ to a selected shape (FIG. 27, *f*), and fired at about 750° C. (FIG. 27, *g*). The above-described steps produce an armature brush 10 composed of the foamed metal 4 with the pores 4*a* filled with the treated graphite 5.

Figure 28:
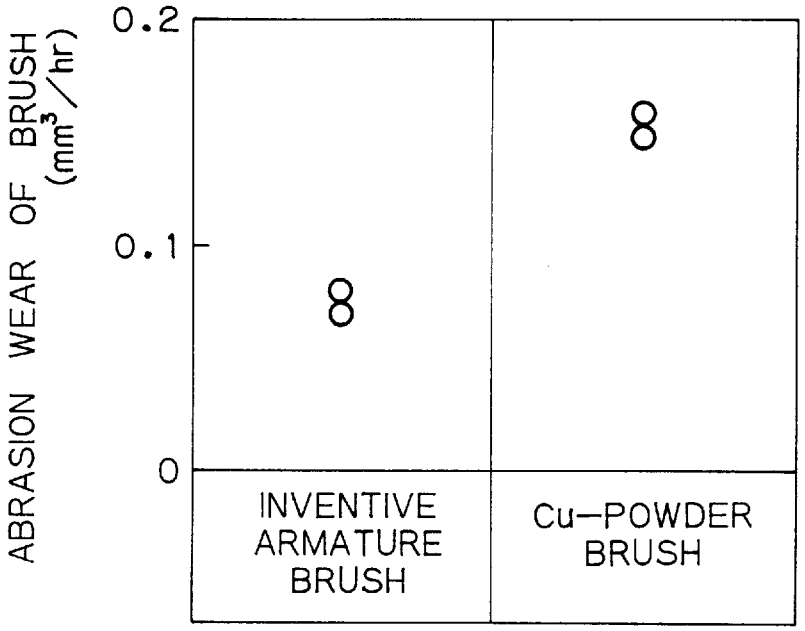
FIG. 28 is a graph showing an estimate of abrasion loss of electric armature brushes by an intermittent durability test.

The thus-produced present inventive armature brush 10 and a conventional Cu powder-containing brush (Cu 55 wt. %, binder 10 wt. %) were mounted on an automobile throttle valve motor to estimate the abrasion wear resistance by an intermittent durability test under the same testing condition. The results are summarized in FIG. 28. The intermittent durability test was conducted by using an operating voltage of 12 V and a cycle of operation for 0.2 sec and a pause for 0.3 sec with forward and backward rotations, which was repeated 600,000 times. This intermittent durability test showed that the present inventive armature brush 10 had an abrasion wear of about one half that of the conventional Cu powder-containing brush.

Figure 29:
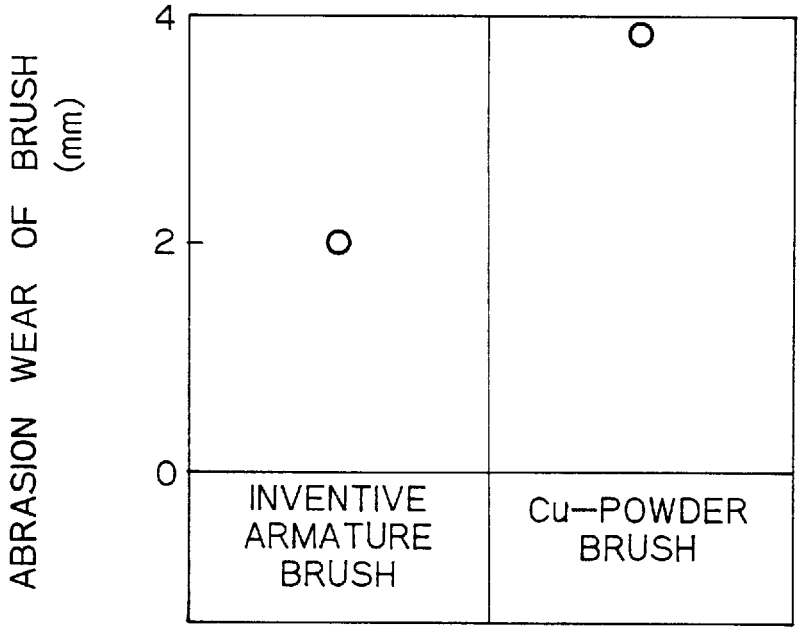
FIG. 29 is a graph showing an estimate of abrasion loss of electric armature brushes by a durability test at an elevated temperature.

By using a similar motor, the abrasion wear was estimated by a durability test (continuously operated at 3600 rpm) under an elevated atmosphere temperature of 100° C. The results are summarized in FIG. 29.

This elevated temperature durability test again showed that the present inventive armature brush 10 had an abrasion wear of about one half that of the conventional Cu powder-containing brush.

EXAMPLE 17

Figure 30:
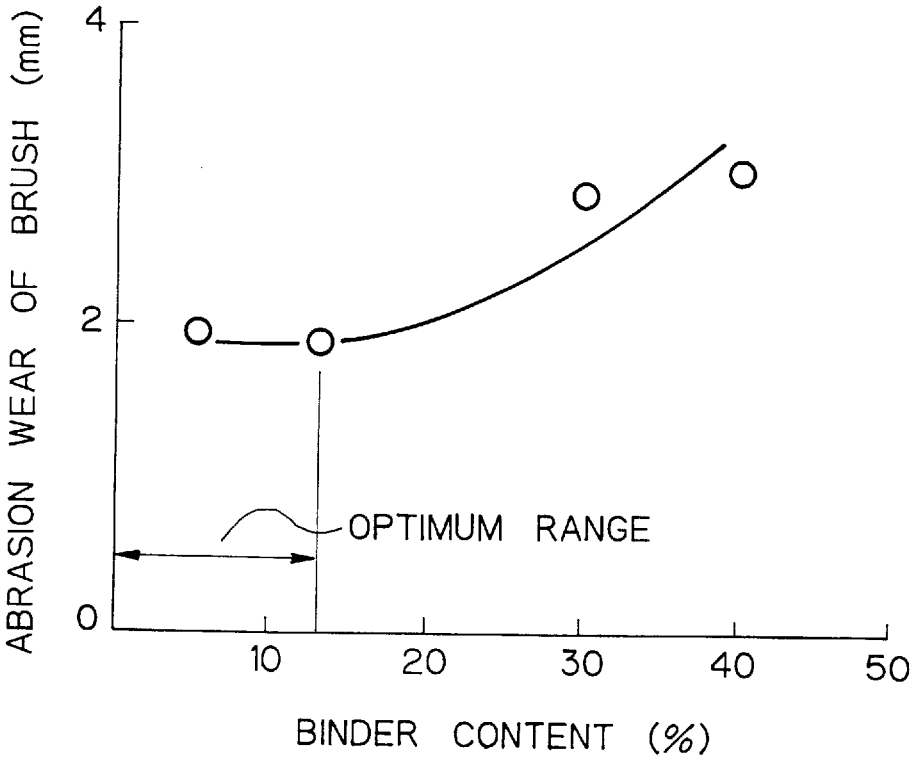
FIG. 30 is a graph showing the relationship between the binder amount and the brush abrasion loss in a durability test at an elevated temperature.

Armature brushes 10 (armature brushes 10 using a foamed metal 4) were produced by the same process as that used in Example 16 except for the binder amount which was varied from 5 to 40 wt. % (relative to graphite). The armature brushes 10 were mounted on a similar motor and the brush abrasion wear was estimated by a durability test under an elevated atmosphere temperature of 100° C. The results are summarized in FIG. 30. This durability test showed that the brush abrasion wear remains substantially unchanged at a small value when the binder amount is 13 wt. % or less and increases with the increase in the binder amount when the latter is more than 13 wt. %.

Although the disclosed intermittently operating motor is a throttle valve motor, there are other intermittently operating motors such as starters, motors for controlling timing of the engine inlet valve, ABS motors, etc. Motors used under an elevated temperature include motors disposed in an automobile engine compartment, such as an electric fan motor.

The present inventive armature brush contains a binder in an amount of 13 wt. % or less with respect to the graphite amount, so that the adhesive force of graphite is reduced to make the brush material soft. This improves the contact stability of an armature brush, reduces the occurrence of sparks during intermittent operation, and suppresses the temperature rise of an armature brush by reduced contact voltage under an elevated temperature, so that the abrasion resistance is improved under intermittent and/or elevated temperature operations, thereby ensuring elongated lifetime.

We claim:

1. A process of producing a composite material comprising the steps of:

Adding a solvent to a mixture comprised of graphite and a binder to form a pasty mixture, wherein said solvent is added in an amount of 50 to 65 wt. % of the total weight; and Spraying said pasty mixture onto a three dimensional continuum of a porous metal, filling pores of said continuum of said porous metal, and then subjecting said continuum to volatilization of nonessential solvent.

2. A process of producing a composite material according to claim 1, wherein said pasty mixture is heated and then sprayed onto said continuum of said porous metal.

3. A process of producing a composite material according to claim 1, wherein said graphite is globular or granular.

4. A process of producing a composite material comprising adding a solvent to a mixture comprised of graphite and a binder to form a pasty mixture, wherein said solvent is added in an amount of 50 to 65 wt. % of the total weight; and spraying said pasty mixture onto a three-dimensional continuum of a porous metal so as to fill pores of said continuum of said porous metal with said mixture.

* * * * *